US005149254A

United States Patent [19]

Riffe

[11] Patent Number: 5,149,254

[45] Date of Patent: Sep. 22, 1992

[54] REFRIGERATION COMPRESSOR HAVING A CONTOURED PISTON

[75] Inventor: Delmer R. Riffe, Cullman, Ala.

[73] Assignee: White Consolidated Industries, Inc., Cleveland, Ohio

[21] Appl. No.: 711,337

[22] Filed: Jun. 6, 1991

[51] Int. Cl.[5] ..... F04B 39/10

[52] U.S. Cl. ..... 417/569; 92/181 R

[58] Field of Search ..... 92/181; 417/569, 570

[56] References Cited

U.S. PATENT DOCUMENTS

| | | | |
|---|---|---|---|
| 1,764,953 | 6/1930 | Heath | 417/569 |
| 2,626,102 | 1/1953 | Garland | 417/569 |
| 4,723,896 | 2/1988 | Fritchman | 417/571 |

*Primary Examiner*—Richard A. Bertsch

*Assistant Examiner*—Charles G. Freay

*Attorney, Agent, or Firm*—Pearne, Gordon, McCoy & Granger

[57] ABSTRACT

A small hermetic refrigeration compressor of the single reciprocating piston-type has flat valve plate extending across the open end of the cylinder with a discharge port extending through the valve plate off the center line of the cylinder bore. The piston has a generally flat end face with a recess at least partially in alignment with the discharge port, to allow improved flow of gases to the discharge port with a decreased clearance volume. Further reduction of the clearance volume can be obtained by placing a projecting post on the end face of the piston in line with the discharge port to partially fill the discharge port at top dead center.

12 Claims, 3 Drawing Sheets

Fig. 2
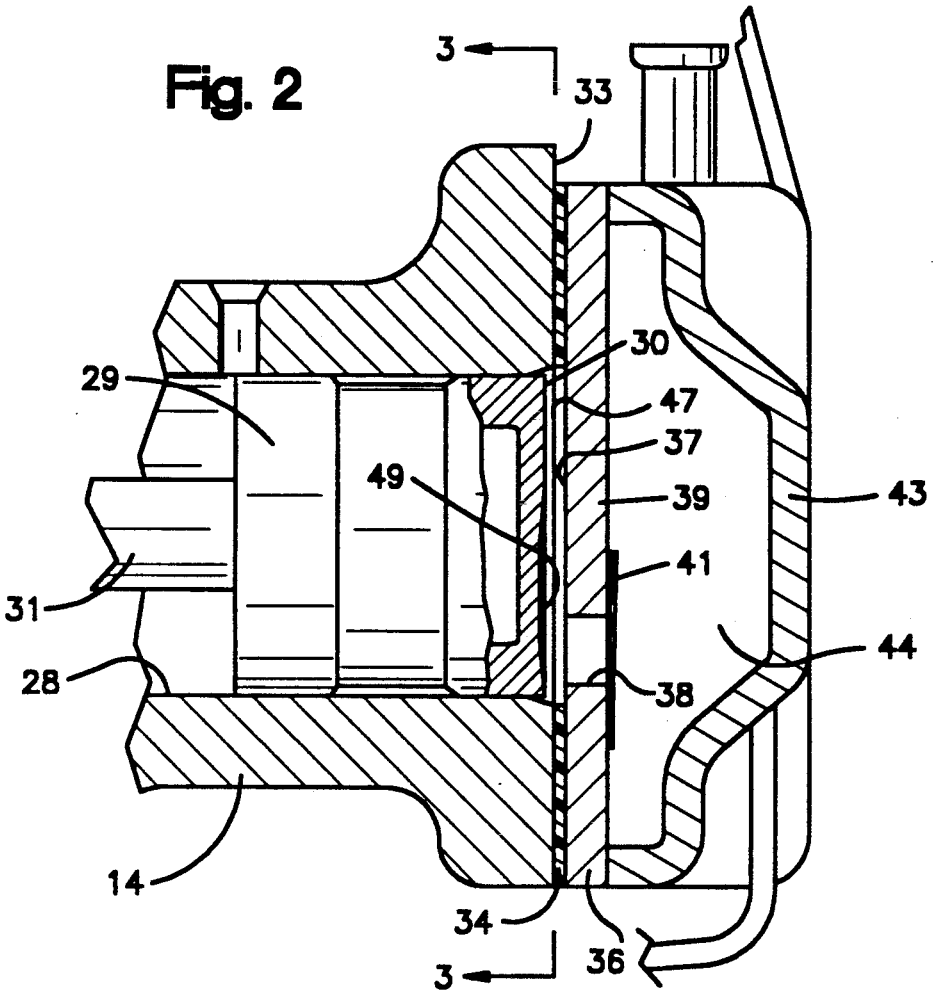
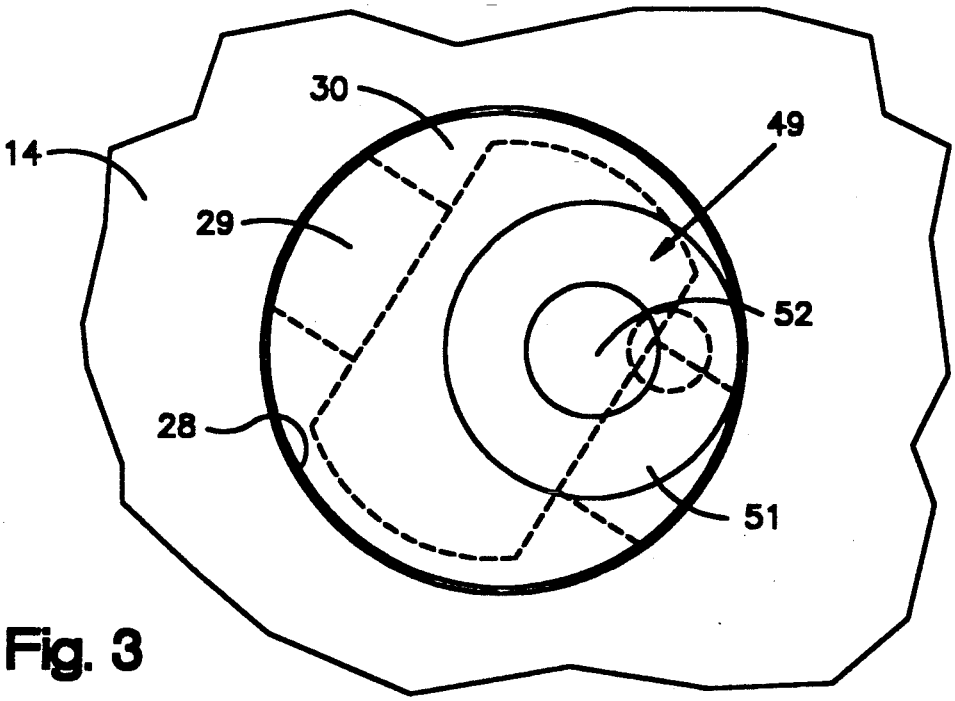
Fig. 3

REFRIGERATION COMPRESSOR HAVING A CONTOURED PISTON

BACKGROUND OF THE INVENTION

This invention relates generally to compressors, and more particularly to hermetic compressors of the fractional horsepower type used in household appliances such as refrigerators and freezers.

The need for increased energy efficiency for household appliances is particularly great for these types of appliances because they use such a large amount of the total electrical energy consumption in the typical household. One of the areas where much improvement has been obtained in these units is the hermetic compressor, which has seen considerable energy efficiency improvement in recent years. While much of the improvement has been in the electric motor portion of the compressor, there still remains further room in the area of volumetric and compression efficiency of the reciprocating piston compressor.

One of the factors affecting the volumetric efficiency of these compressors is the clearance or re-expansion volume of the pumping cylinder, which is defined as the volume of space within the pumping cylinder when the piston is at top center or the end of its pumping stroke. This space consists essentially of the space between the piston face and the valve plate on which the suction and discharge reed valves are mounted as well as the volume of the discharge port in the valve plate, since the discharge valve reed valve is on the outer side of the valve plate, while the suction valve is on the inner side of the valve plate so that the volume of the suction port is outside of the clearance volume. The ideal compressor would have no clearance volume, and generally, the greater the clearance volume, the lower the efficiency of the compressor. The reason that clearance volume adversely affects efficiency is that this volume constitutes gases that require additional work or energy for compression on the working stroke of the piston, and this energy is only partially recovered on the suction stroke as the cylinder is refilled through the suction port. Thus, reduction of the clearance volume will increase the efficiency of the compressor as long as other factors are not also adversely affected.

Since the clearance volume consists mostly of the above-described two components, efforts to reduce this volume have taken the form of minimizing the distance between the piston face and the valve plate, or more specifically, the valve sheet incorporating the suction valve reed. As for the volume of the discharge port, the diameter cannot be reduced below a certain minimum because this would increase the restriction to discharge flow, and the length of the port must be sufficient in terms of valve plate thickness for the necessary strength to resist the forces of the compressed refrigerant. While some port length reduction has been accomplished by recessing the discharge valve in the valve plate as disclosed in U.S. Pat. No. 4,723,896, granted Feb. 9, 1988 to J. F. Fritchman and assigned to the assignee of the present invention, strength requirements still need enough valve plate material that the discharge port remains a substantial portion of the total clearance volume.

Because of the problem of tolerances in the various parts, the clearance volume from the spacing between the piston end face and the valve sheet has been carefully controlled by a selective thickness fit for the gasket located between the end surface or face on the cylinder block and the valve sheet. It has been found that if this spacing is reduced too much, the compression efficiency is actually reduced. This has been found to be the result of the fact that the discharge port is not only a fraction of the size of the cylinder bore, but also is usually located off the center of the cylinder axis. Thus, as the piston reaches the end of the compression stroke and the clearance space approaches the minimum, the compressed refrigerant gas must flow laterally across the piston face to reach the discharge port. If the spacing between the piston face and the valve sheet is reduced too much, the compressor efficiency is actually reduced because some of the compressed gas becomes effectively trapped in the clearance space since it does not have time with the high speed of the compressor to flow toward and reach the discharge port before the piston reverses direction. As a result, reducing the clearance space at the piston face below a certain minimum may actually reduce the compression efficiency of the compressor by increasing the mass of the gas compressed and re-expanded within the clearance volume.

SUMMARY OF THE INVENTION

The present invention provides a substantial improvement in the volumetric efficiency of the compressor by reducing the clearance volume of the compressor while maintaining efficient gas flow even at the end of the compression stroke.

According to one aspect of the present invention, efficient gas flow from across the face of the piston to the discharge port is maintained when the piston is at the end of the compression stroke by providing a shallow contoured recess in the piston head in the area adjacent the discharge port to allow improved gas flow in this area while the portions of the piston head farther away from the discharge port are allowed to move closer to the valve plate and valve sheet than would otherwise be possible without adversely affecting gas flow from these portions to the port. The contour is shaped so that the spacing between the piston and the valve sheet increases closer to the discharge port to a maximum at a point located near or at the discharge port. This contoured portion is restricted to the central portion of the piston head while the outer portion of the piston head closest to the cylinder wall remains in a plane parallel to the valve plate.

According to another aspect of the invention, the clearance volume is further reduced by providing a projection on the piston face that enters the discharge port at the end of the compression stroke. The projection is formed in cross-section to conform to the shape of the port, while the sides of the projection may be straight or tapered, so that as the projection enters the port, it displaces much of the clearance volume of the port as the piston reaches the end of its movement. The shape of the projection is such that it displaces a substantial portion of the clearance volume constituted by the port itself without adversely affecting the flow of gas through the port at the end of the stroke.

When these two features of the contoured recess on the cylinder head and the projection into the discharge port are combined in the same compressor, the exact shape and size of each can be optimized to produce the maximum reduction in clearance volume and minimum mass of the trapped gas. Thus, the contoured recess can be increased in size and volume while decreasing the space between the piston head and the valve sheet around the outside edge of the piston because of the displacement of the piston projection or plug that enters the discharge port. Likewise, the size and shape of the piston projection can be made to maintain optimum flow through the discharge port at the end of the stroke to accommodate the flow from the contoured recess.

BRIEF DESCRIPTION OF THE DRAWINGS

FIG. 2 is a fragmentary sectional view of the piston and cylinder head of the compressor;

FIG. 3 is an end view of the piston head, taken on line 3—3 of FIG. 2;

DESCRIPTION OF THE PREFERRED EMBODIMENTS

Figure 1:
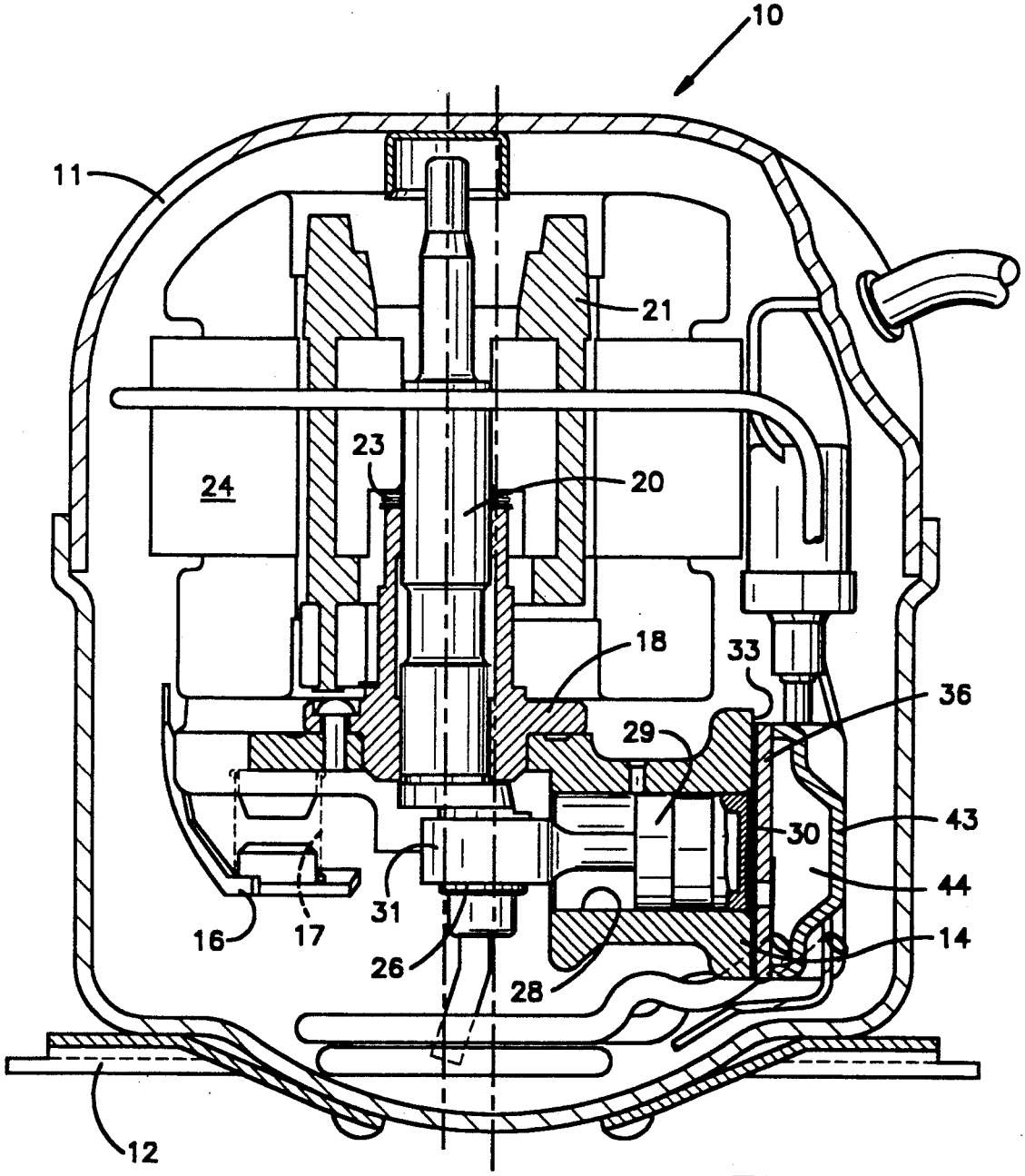
FIG. 1 is an elevational view, partly in section, of a hermetic refrigeration compressor incorporating the invention.
Figure 4:
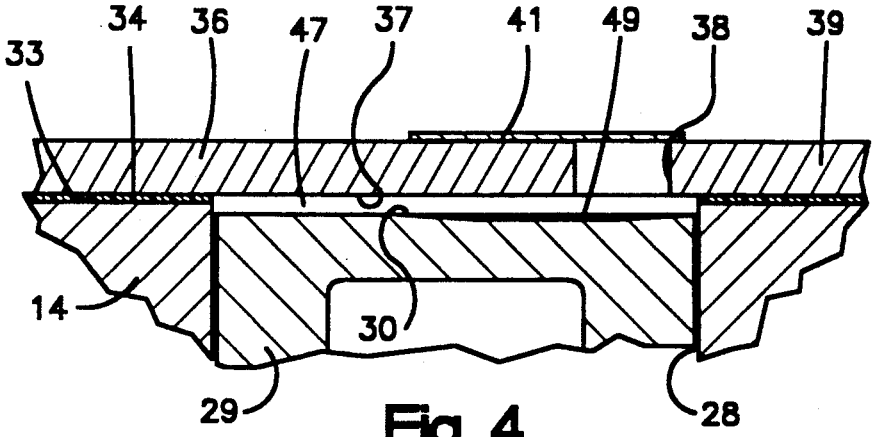
FIG. 4 is a fragmentary sectional view of the piston head and valve plate according to one embodiment of the invention.

Referring to the Figures in greater detail, FIG. 1 shows a compressor 10 of the hermetic refrigeration type used in household refrigerators and freezers. This compressor is of the single reciprocating piston type, and is driven by a two-pole induction motor having a nominal speed of 3600 rpm and a power in a range between one-sixth and one-quarter horsepower for most applications. The compressor is mounted entirely within a formed steel shell 11 which is completely sealed except for the refrigerant gas supply and discharge lines, as well as the necessary electrical connections. The shell 11 is generally formed in two pieces, and includes a mounting base 12, so that the compressor can be mounted, preferably using resilient rubber mounts, on a suitable frame rail in the appliance. The shell 11 has an interior that is at the inlet pressure which corresponds to the outlet from the evaporator so that generally the interior shell 11 is at a relatively low pressure compared to the discharge pressure of the compressor leading into the system condenser.

Mounted within shell 11 is a cylinder block 14 which is resiliently mounted suitable means such as support bracket 16 by means of a spring 17. The cylinder block 14 is thus free to move a limited distance within the shell 11, as is necessary because of the unbalanced forces created during the starting and stopping of the driving motor.

The cylinder block 14 includes a central bearing member 18 having a bore within which is journaled a vertically extending crankshaft 20. Above the bearing member 18, crankshaft 20 carries a motor rotor 21, which is spaced from the end of the bearing member 18 by a suitable thrust bearing 23. Rotor 21 fits within a stator 24 which is fixedly held in place on the top of cylinder block 14. At its lower end, crankshaft 20 has an eccentric crank 26 below the bearing member 18 in general alignment with a horizontally extending cylinder bore 28 formed in the cylinder block and serving to journal a piston 29 which is connected by means of connecting rod 31 to crank 26, so that rotation of the crankshaft 20 cause the piston 29 to reciprocate within bore 28 in the well known manner.

On the side away from crank 26, cylinder block 14 is formed of a flat end face 33 extending perpendicular to the axis of cylinder bore 28 in a plane that is parallel to, but with a predetermined spacing from, the end face 30 of piston 29, as will be explained in greater detail hereinafter.

A suitable gasket 34 is placed on top of the end face 30, and on top of that is located the valve plate 36. It will also be understood that a thin sheet metal valve sheet which incorporates the suction valve may be placed between the plate 36 and gasket 34, but since that valve sheet is not relevant to the present invention, it has not been shown, nor will it be further described. The inner face 37 of valve plate 36 therefore extends in planar fashion across the end of cylinder bore 28 parallel with the piston end face 30. Valve plate 36 includes a discharge port 38 extending therethrough from the piston end face 30 to the outer face 39 of valve plate 36, where it is closed off by a suitable reed-type discharge valve 41. Discharge valve 41 will normally make sealing engagement with the valve plate 36 during the suction stroke of piston 29 as it moves away from valve plate 36, and will open on the compression stroke of the piston as it forces gases out through the discharge port 38 to thereby open the discharge valve 41. The cylinder head 43 extends over the valve plate 36 to define a discharge plenum 44 which receives the gases from the interior of the cylinder through the discharge port 38. It will be understood that the cylinder head 43 is rigidly secured to the cylinder block 14 by suitable means, such as bolts (not shown), and that the discharge plenum 44 is, in turn, connected through suitable mufflers to a discharge tube connected to the exterior shell 11, so that the gases from the discharge plenum 44 are conducted in a closed circuit to the exterior of the compressor shell.

As the piston 29 reciprocates within the cylinder bore 28, its pumping cycle consists of a suction or downward stroke as the piston moves from top dead center toward bottom dead center, and during this cycle, the suction valve (not shown) opens to allow the refrigerant gases to enter the cylinder. After the piston passes bottom dead center, it again moves on the compression stroke toward the valve plate 36. Since the valves of the compressor are not positively actuated, the discharge valve 41 is able to open only after the pressure within the cylinder bore exceeds that within the discharge plenum 44. Therefore, the discharge valve 41 does not begin to open until the piston is moved through a substantial portion of its compression stroke. However, once the discharge valve 41 has opened, the gases within the cylinder bore 28 will be forced by the piston 29 to flow through the discharge port 38 into the discharge plenum 44, and as the piston 29 reaches the end of its stroke or top dead center, where the face 30 is closest to the valve plate 36, the discharge valve 41 tends to remain open for the last gases to leave the cylinder bore 28 until the discharge valve 41 recloses after the piston reverses its direction and the pressure within the cylinder bore 28 drops. When the piston 29 is at top dead center, as shown in FIG. 2, there is necessarily a space 47, called the "clearance space", remaining between the piston end face 30 and the valve plate 36 (disregarding any valve sheet for the suction valve which, for purposes of this discussion, may be considered as an integral part of the valve plate 36). This clearance space, together with the volume of the discharge port 38, makes up the total clearance volume of the compressor and represents gases that have been compressed but which do not leave the cylinder and pass into the discharge plenum 44. These gases then re-expand as the piston moves in the beginning of the suction stroke, and since the compression and expansion of the refrigerant gases is not a true adiabatic process, there is necessarily some energy left in the form of heat that is absorbed by the surrounding mechanism. Since this energy loss is proportional to the amount of gases trapped in the clearance volume, it has long been recognized that minimizing clearance volume is a way to increase the energy efficiency of the compressor.

Heretofore, compressors of this type have generally been made with a flat end face on the piston, and when the compressor is assembled, gauging is used to determine the exact location of the piston end face 30 with respect to the cylinder block end face 33 and the gasket 34 is then made a selective fit so that the clearance distance between the piston end face and the valve plate is held within a predetermined range. If this distance is too great, obviously, the total clearance volume is increased and the efficiency of the compressor thereby decreased. If the clearance distance is too small, the obvious risk is that, depending upon the temperatures of the various parts of the compressors and variations in thermal expansion, the possibility could exist that the piston might actually contact the valve plate with very damaging results. What has not been generally recognized is that when the distance is reduced below a certain minimum, dependent upon the dimensional factors of the compressor, the actual mass of refrigerant remains substantially constant even as the clearance distance is further decreased, because the refrigerant is unable to flow from the most remote parts of the piston face to the discharge port. This problem is further compounded by the fact that the need to provide for large suction ports and valves, in view of the fact that suction differential pressures are much lower than discharge differential pressures across the respective valves, generally requires that the discharge port 38 be located considerably off the centerline of the cylinder bore and very often fairly close to the walls of the cylinder bore, and hence the edge of the piston face 30, as clearly shown in FIG. 3. Because this opening is so close to the one edge of the bore, the refrigerant gases at the farthest point from the port must flow a considerable distance laterally as the piston reaches top dead center in order to be discharged through the port 38. Thus, there is a point beyond which a further decrease in the clearance distance produces no increases in efficiency, but may in fact produce a slight decrease in efficiency because the gases trapped in this area undergo even greater compression and re-expansion.

According to one aspect of the present invention, the piston end face 30 is changed from its normal flat configuration by the addition of a shallow recess 49 formed on the piston face adjacent the discharge port 38. The recess 49 may be circular in form with a shallow sloping conical portion 51 and a flat, recessed circular center portion 52. Preferably, at least a part of the center portion 52 overlies a part of the discharge port 38, as shown in FIG. 3, to ensure that the maximum clearance between the piston and the valve plate coincides with the location of the discharge port.

The recess 30 may be made quite shallow in depth, being on the order of the normal clearance distance of the piston face from the valve plate. It has been found that the clearance distance between the remaining portions of the piston end face 30 and the valve plate may now be further decreased below the distance normally used, so that the total clearance space between the piston and the valve plate is substantially reduced in volume. For example, in a compressor having a 1 inch bore, the normal clearance distance may be about 0.006 inch and this can be reduced to about 0.002 inch with a recess depth of about 0.005 inch. However, the recess 49 allows the gases in the other portions of the piston end face to flow more readily toward the discharge port 38, even at top center, so that the mass of the compressed gas is decreased. It has been found that the mere addition of the recess 49 to the piston end face may result in an improvement of about 1.5% in the energy efficiency ratio of the compressor, assuming all other factors remain a constant.

Figure 5:
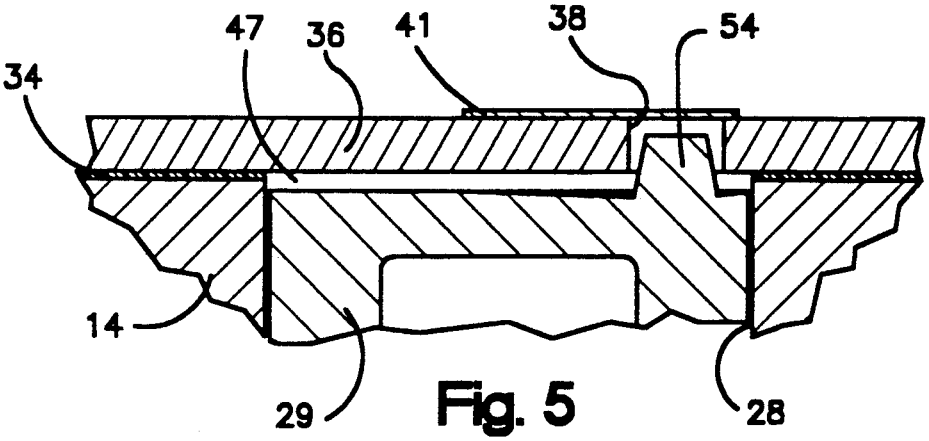
FIG. 5 is a fragmentary sectional view similar to FIG. 4 of another embodiment of the invention.
Figure 6:
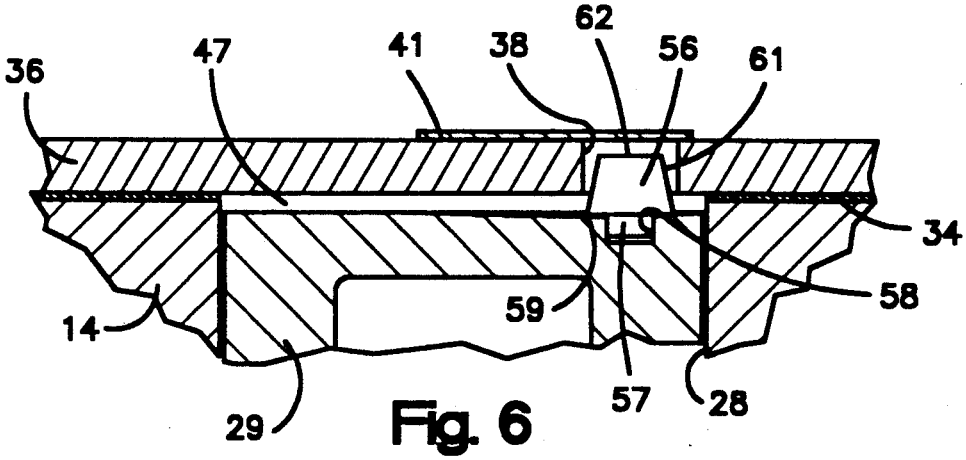
FIG. 6 is a fragmentary sectional view similar to FIGS. 4 and 5 of still another embodiment of the invention.

The clearance volume can be further decreased, as shown in FIGS. 5 and 6 by the addition of a projection or post on the piston face that extends into the discharge port 38 to displace a substantial portion of the clearance volume made up by the volume of the discharge port. While this post or projection can be used alone, it is preferably used in combination with the recess 49. While it is possible that the post 54 can be made integral with the piston 29, as shown in FIG. 5, it may not be feasible from a production standpoint to make the post integral, particularly with the necessity to machine the recess 49, and therefore it may be more conveniently made as a separate piece as shown in FIG. 6. The post 56 has a reduced diameter shank 57 which is suitably secured, by means such as a press-fit, into a bore 58 formed in the piston 29 so that the bottom face 59 of the post abuts against the piston end face 30. The post 56 is centered to be coaxial with the discharge port 38, or if the latter is noncircular, to have a suitable configuration to ensure that no portion of the post 56 can contact any portion of the valve plate 36 when the piston is at top center position. Although post 56 may be cylindrical with straight sides, it may be preferable to have it formed with conical sides 61 and a flat end face 62, which is spaced to have a suitable clearance from the discharge valve 41. If the sides 61 of post 56 are conical, before the piston reaches top dead center, only the smaller end face 62 on post 56 will actually enter into the discharge port 38 beyond the inner face 37 of valve plate 36. Because of this reduced diameter, the discharge port still has a substantial area to allow the remaining gases within the cylinder to enter the discharge port 38, and since this volume as well as the velocity of flow will tend to decrease as the piston exactly approaches top dead center, the conical sides 61 become progressively closer to the walls of the discharge port 38 so as to be able to substantially fill that portion of the discharge port which contributes to the clearance volume. Furthermore, since the recess 49 is still adjacent the discharge port, it will further assist in collecting the gases around the outer periphery of the piston to enable them to flow past the post 56 into the discharge port 38 and past the discharge valve 41. Although the post can be used with a flat faced piston without the recess, by combining the features of both the recess on the piston head and the post extending into the discharge valve, it is possible to obtain still further increases in the energy efficiency ratio of the compressor as a result of the reduced clearance volume and improved flow path for the discharge gases at the end of the stroke.

Although several embodiments of the invention have been shown and described in detail, it will be understood that various other modifications and rearrangements may be resorted to without departing from the scope of the invention as defined in the claims.

What is claimed is:

1. A hermetic refrigeration compressor comprising a cylinder block having an end surface, a cylinder bore extending through said cylinder block from said end surface and defining an axis perpendicular to said end surface, a valve plate secured to said end surface and having a flat surface extending across said cylinder bore, a piston mounted for reciprocation in said cylinder bore, means to reciprocate said piston in said cylinder bore to and from said valve plate, a discharge port extending through said valve plate and opening into said cylinder bore, said piston having an end face extending adjacent said valve plate, said end face including a recessed portion with at least part of said recessed portion being in alignment with at least part of said discharge port, the remainder of said piston end face around said recessed portion being flat and parallel to said valve plate surface.

2. A hermetic refrigeration compressor as set forth in claim 1, wherein said recess has a depth greater than the minimum spacing between said remainder of said piston end face and said valve plate.

3. A hermetic refrigeration compressor as set forth in claim 1, wherein said recess is circular in shape and is offset from the central axis of said cylinder bore.

4. A hermetic refrigeration compressor as set forth in claim 3, wherein said recess has a conical outer portion and a flat center portion.

5. A hermetic refrigeration compressor as set forth in claim 4, wherein at least part of said center portion is in alignment with at least part of said discharge port.

6. A hermetic refrigeration compressor comprising a cylinder block having an end surface, a cylinder bore extending through said cylinder block from said end surface and defining an axis perpendicular to said end surface, a valve plate secured to said end surface and extending across said cylinder bore, a piston mounted for reciprocation in said cylinder bore, means to reciprocate said piston in said cylinder bore to and from said valve plate, a cylindrical discharge port extending through said valve plate and opening into said cylinder bore at a point offset from said axis, said piston having an end face extending adjacent said valve plate, and a conical projecting post on said piston extending outward from said end face into said discharge port when said piston is at top center adjacent said valve plate.

7. A hermetic refrigeration compressor comprising a cylinder block having an end surface, a cylinder bore extending through said cylinder block from said end surface and defining an axis perpendicular to said end surface, a valve plate secured to said end surface and extending across said cylinder bore, a piston mounted for reciprocation in said cylinder bore, means to reciprocate said piston in said cylinder bore to and from said valve plate, a discharge port extending through said valve plate and opening into said cylinder bore at a point offset from said axis, said piston having an end face extending adjacent said valve plate, said end face including a recessed portion with at least part of said recessed portion being in alignment with at least part of said discharge port, and a post on said piston extending outward from said piston end face into said discharge port when said piston is at top center adjacent said valve plate.

8. A hermetic refrigeration compressor as set forth in claim 7, wherein said valve plate has a flat surface extending across said cylinder bore with the remainder of said piston end face around said recess portion being flat and parallel to said valve plate surface, said post being positioned within said recess.

9. A hermetic refrigeration compressor as set forth in claim 7, wherein said post is a separate member secured to said piston face.

10. A hermetic refrigeration compressor as set forth in claim 8, wherein said recess is circular in shape and offset from the central access of said cylinder bore.

11. A hermetic refrigeration compressor as set forth in claim 10, wherein said recess has a conical outer portion and a flat center portion.

12. A hermetic refrigeration compressor as set forth in claim 11, wherein said discharge port is cylindrical and said post is conical.

* * * * *